US009719501B2

(12) United States Patent
Honda et al.

(10) Patent No.: US 9,719,501 B2
(45) Date of Patent: Aug. 1, 2017

(54) SWASH PLATE TYPE VARIABLE DISPLACEMENT COMPRESSOR

(71) Applicant: KABUSHIKI KAISHA TOYOTA JIDOSHOKKI, Kariya-shi, Aichi-ken (JP)

(72) Inventors: Kazunari Honda, Aichi-ken (JP); Shinya Yamamoto, Aichi-ken (JP); Hiromichi Ogawa, Aichi-ken (JP); Kei Nishii, Aichi-ken (JP); Yusuke Yamazaki, Aichi-ken (JP)

(73) Assignee: KABUSHIKI KAISHA TOYOTA JIDOSHOKKI, Kariya-shi (JP)

( * ) Notice: Subject to any disclaimer, the term of this patent is extended or adjusted under 35 U.S.C. 154(b) by 210 days.

(21) Appl. No.: 14/537,447

(22) Filed: Nov. 10, 2014

(65) Prior Publication Data

US 2015/0132156 A1 May 14, 2015

(30) Foreign Application Priority Data

Nov. 13, 2013 (JP) ..... 2013-235377

(51) Int. Cl.
*F04B 27/10* (2006.01)
*F04B 27/18* (2006.01)
(Continued)

(52) U.S. Cl.
CPC ..... *F04B 27/1054* (2013.01); *F04B 27/1063* (2013.01); *F04B 27/1072* (2013.01);
(Continued)

(58) Field of Classification Search
CPC . F04B 1/16; F04B 1/295; F04B 1/146–1/148; F04B 27/10;
(Continued)

(56) References Cited

U.S. PATENT DOCUMENTS 4,174,191 A * 11/1979 Roberts ..... F04B 27/18 417/222.1
4,425,837 A * 1/1984 Livesay ..... F04B 27/12 417/269
(Continued)

FOREIGN PATENT DOCUMENTS

CN 1327518 A 12/2001
CN 101403375 A 4/2009
(Continued)

OTHER PUBLICATIONS

Communication dated Apr. 15, 2016 from the State Intellectual Property Office of the P.R.C. in counterpart Application No. 201410645461.4.
(Continued)

*Primary Examiner* — Alexander Comley
(74) *Attorney, Agent, or Firm* — Sughrue Mion, PLLC

(57) ABSTRACT

A swash plate type variable displacement compressor includes, a housing, a swash plate disposed in the housing and having therethrough an insertion hole, a rotary shaft inserted through the insertion hole of the swash plate, a plurality of pistons engaged with the swash plate, and a connecting member disposed between the rotary shaft and the swash plate and connecting the rotary shaft and the swash plate so as to change inclination angle of the swash plate relative to the rotary shaft. A pair of projections are provided in the insertion hole so as to extend toward the rotary shaft and restrict the movement of the swash plate relative to the rotary shaft. The paired projections are spaced away from each other so as not to be in contact with the rotary shaft simultaneously.

8 Claims, 6 Drawing Sheets

(51) Int. Cl.
*F04B 49/12* (2006.01)
*F04B 27/08* (2006.01)

(52) U.S. Cl.
CPC ..... *F04B 27/18* (2013.01); *F04B 27/0895* (2013.01); *F04B 49/123* (2013.01)

(58) Field of Classification Search
CPC ..... F04B 27/1054–27/1063; F04B 27/0895; F04B 49/123
USPC ..... 417/218, 222.1, 222.2, 269; 92/12.1, 92/12.2, 13, 71
See application file for complete search history.

(56) References Cited

U.S. PATENT DOCUMENTS 4,846,049 A * 7/1989 Terauchi ..... F04B 27/1072 417/269
4,932,843 A * 6/1990 Itoigawa ..... F04B 27/12 417/222.1
4,963,074 A * 10/1990 Sanuki ..... F04B 27/18 417/222.1
5,032,060 A * 7/1991 Kobayashi ..... F04B 27/12 417/222.1
5,259,736 A * 11/1993 Terauchi ..... F01B 3/106 417/222.1
5,292,233 A * 3/1994 Takenaka ..... F04B 27/1072 417/222.2
5,370,503 A * 12/1994 Terauchi ..... F04B 27/1072 417/222.2
5,699,716 A * 12/1997 Ota ..... F04B 27/1072 417/269
5,722,310 A * 3/1998 Ota ..... F04B 27/1072 417/222.2
5,749,712 A * 5/1998 Umemura ..... F04B 27/1072 417/269
5,882,179 A * 3/1999 Ota ..... F04B 27/1804 417/222.1
5,882,180 A * 3/1999 Kawaguchi ..... F04B 27/1804 417/222.2
6,044,751 A * 4/2000 Kimura ..... F04B 27/1072 417/269
6,048,178 A * 4/2000 Kawaguchi ..... F04B 27/1081 417/222.2
6,162,025 A * 12/2000 Okawa ..... F04B 27/1072 417/222.2
6,164,929 A * 12/2000 Kazuya ..... F04B 39/066 417/222.2
6,186,048 B1 * 2/2001 Kimura ..... F04B 27/1072 91/505
6,217,293 B1 * 4/2001 Murase ..... F04B 27/1804 417/222.2
6,293,761 B1 * 9/2001 Ganster ..... F04B 27/1072 417/222.1
6,508,633 B2 * 1/2003 Matsubara ..... F04B 27/1072 417/222.2
6,517,321 B1 * 2/2003 Takenaka ..... F04B 27/0895 417/222.1
6,524,079 B1 * 2/2003 Kimura ..... F04B 27/1804 417/269
6,553,890 B2 * 4/2003 Ahn ..... F04B 27/1072 92/12.2
7,490,540 B2 * 2/2009 Schwarzkopf ..... F04B 27/1054 92/12.2
7,972,118 B2 7/2011 Hirabayashi et al.
8,196,506 B2 * 6/2012 Sabha ..... F04B 1/146 417/222.1
2005/0276699 A1 * 12/2005 Kuhn ..... F04B 27/1072 417/222.1
2007/0220859 A1 * 9/2007 Kubo ..... F04B 27/0886 60/226.3
2008/0223208 A1 * 9/2008 Lee ..... F01B 3/007 92/71
2009/0107327 A1 * 4/2009 Ota ..... F04B 27/18 92/13
2009/0178552 A1 * 7/2009 Kawamura ..... F04B 27/1072 91/505
2009/0246050 A1 * 10/2009 Miyaji ..... F04B 27/1072 417/437
2010/0135828 A1 * 6/2010 Lee ..... F04B 27/1072 417/269
2011/0088547 A1 * 4/2011 Tagami ..... F04B 27/0895 92/12.2
2013/0343920 A1 * 12/2013 Lee ..... F04B 1/146 417/222.1

FOREIGN PATENT DOCUMENTS

DE 69203709 T2 4/1996
DE 19622869 A1 12/1996
JP 2000-170651 A 6/2000
JP 2000170651 A * 6/2000
JP 2005-113841 A 4/2005
KR 1020010080231 A 8/2001
KR 10-2008-0052914 A 6/2008
KR 1020090034767 A 4/2009

OTHER PUBLICATIONS

Communication dated Apr. 7, 2017, issued by the German Patent Office in counterpart German Application No. 102014223091.8.

* cited by examiner

SWASH PLATE TYPE VARIABLE DISPLACEMENT COMPRESSOR

BACKGROUND OF THE INVENTION

The present invention relates to a swash plate type variable displacement compressor.

A swash plate type variable displacement compressor includes a swash plate in a housing. The swash plate has an insertion hole through which a rotary shaft is inserted and is driven to rotate by the rotary shaft. Pistons are connected to the swash plate. The housing has therein a control pressure chamber. The pressure in a control pressure chamber is changed in response to the pressure of refrigerant gas introduced into the control pressure chamber, with the result that the inclination angle of the swash plate with respect to the axis of the rotary shaft is changed and stroke length of the piston is changed, accordingly. As a result, the discharge displacement of the compressor is changed.

In a swash plate type variable displacement compressor, compression reaction force acts on the swash plate from the piston. It is noted that the swash plate has a point at which one of the pistons is positioned at a top dead center, or the top dead center point and a point at which one of the pistons is positioned at a bottom dead center, or the bottom dead center point. This compression reaction force may cause the swash plate in a direction that is different from the direction in which the swash plate is inclined in accordance with the displacement control of the compressor, about the line connecting the top dead center point and the bottom dead center point of the swash plate. In such a case that the swash plate is inclined in such different direction, the edge of the inner peripheral surface of an insertion hole of the swash plate, which is perpendicular to the axis of rotation of the rotary shaft and the line connecting the top dead center point and the bottom dead center point of the swash plate, are brought into contact with the rotary shaft. Therefore, there is fear that the swash plate may fail to change its inclination angle smoothly.

Japanese Patent Application Publication No. 2000-170651 discloses a swash plate type variable displacement compressor which is designed to prevent the edge of the inner peripheral surface of an insertion hole of a swash plate from being brought into contact with a rotary shaft when the swash plate is inclined in a direction that is different from the direction in which the swash plate is inclined in accordance with the displacement control of the compressor.

Referring to FIG. 11 showing the swash plate type variable displacement compressor disclosed by the above Publication, the swash plate designated by reference numeral 101 has an insertion hole 102 through which a rotary shaft 103 is inserted. The swash plate 101 has two contact pins 104A and 104B that are formed extending from the inner surface of the insertion hole 102 in the direction (or the arrow direction Z10 in FIG. 11) that is perpendicular to the axis L11 of rotation of the rotary shaft 103 and the line connecting the top dead center point and the bottom dead center point of the swash plate 101. The contact pins 104A and 104B are provided in the inner surface of the insertion hole 102 at positions adjacent to one end thereof as viewed in the axial direction of the rotary shaft 103. The swash plate 101 further has two contact pins 104C and 104D that are formed extending from the inner surface of the insertion hole 102 in the direction that is perpendicular to the axis L11 of rotation of the rotary shaft 103 and the line connecting the top dead center point and the bottom dead center point of the swash plate 101. The contact pins 104C and 104D are provided in the inner surface of the insertion hole 102 at positions adjacent to the other end thereof as viewed in the axial direction of the rotary shaft 103. The contact pins 104A, 104B, 104C, 104D are in constant contact with the rotary shaft 103.

When the compression reaction force P10 from the pistons acts on the swash plate 101, the swash plate 101 tends to be inclined about the line L12 connecting the top center point and the dead center point of the swash plate 101 in a direction that is different from the direction in which the swash plate 101 is inclined in accordance with the displacement control of the compressor (or arrow R10 in FIG. 11). Since the contact pins 104A, 104B, 104C, 104D are in constant contact with the rotary shaft 103, the contact between the rotary shaft 103 and each of the edges 102A and 1028 of the inner peripheral surface of the swash plate 101, which are located in the perpendicular direction to the axis L11 of the rotary shaft 103 and the line L12 connecting the top center dead point and the bottom dead center point of the swash plate 101, are prevented. As a result, the inclination angle of the swash plate 101 is changed smoothly.

In the swash plate type variable displacement compressor of the above-cited application, however, the contact pins 104A, 104B, 104C, 104D are kept in constant contact with the rotary shaft 103 when the swash plate 101 tends to be inclined in the direction against the displacement control of the compressor by the compression reaction force P10 exerted from pistons and acting on the swash plate 101. Therefore, the friction occurring between each of the contact pins 104A, 104B, 104C, 104D and the rotary shaft 103 prevents smooth change of the inclination angle of the swash plate 101.

It may be contemplated to set the spaced distance between the inner peripheral surface of the insertion hole 102 of the swash plate 101 and the rotary shaft 103 is larger enough for the edges 102A, 1028 not to be brought into contact with the rotary shaft 103 when the swash plate 101 is inclined in the direction against the displacement control of the compressor. In this case, however, the swash plate 101 tends to move easily toward the direction that is perpendicular to the axis L11 of the rotary shaft 103 and to the line L12 connecting the top center point and the dead center point of the swash plate 101, with the result that the positioning accuracy of the swash plate 101 with respect to the rotary shaft 103 deteriorates.

The present invention is directed to providing a swash plate type variable displacement compressor that permits smooth changing of the inclination angle of the swash plate while maintaining accuracy in the positioning of the swash plate.

SUMMARY OF THE INVENTION

In accordance with an aspect of the present invention, there is provided a swash plate type variable displacement compressor includes, a housing, a swash plate disposed in the housing and having therethrough an insertion hole, a rotary shaft inserted through the insertion hole of the swash plate, a plurality of pistons engaged with the swash plate, and a connecting member disposed between the rotary shaft and the swash plate and connecting the rotary shaft and the swash plate so as to change inclination angle of the swash plate relative to the rotary shaft. The swash plate has a first point at which one of the pistons is positioned at a top dead center and a second point at which one of the positions is positioned at a bottom dead center. The swash plate is variable relative to the rotary shaft in a direction that is perpendicular to an axis of rotation of the rotary shaft and a line connecting the first point and the second point of the swash plate. When the inclination angle of the swash plate is changed relative to the rotary shaft, stroke lengths of the pistons are changed to vary displacement of the compressor. A pair of projections are provided in the insertion hole so as to extend toward the rotary shaft and restrict the movement of the swash plate relative to the rotary shaft. The paired projections are spaced away from each other so as not to be in contact with the rotary shaft simultaneously.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
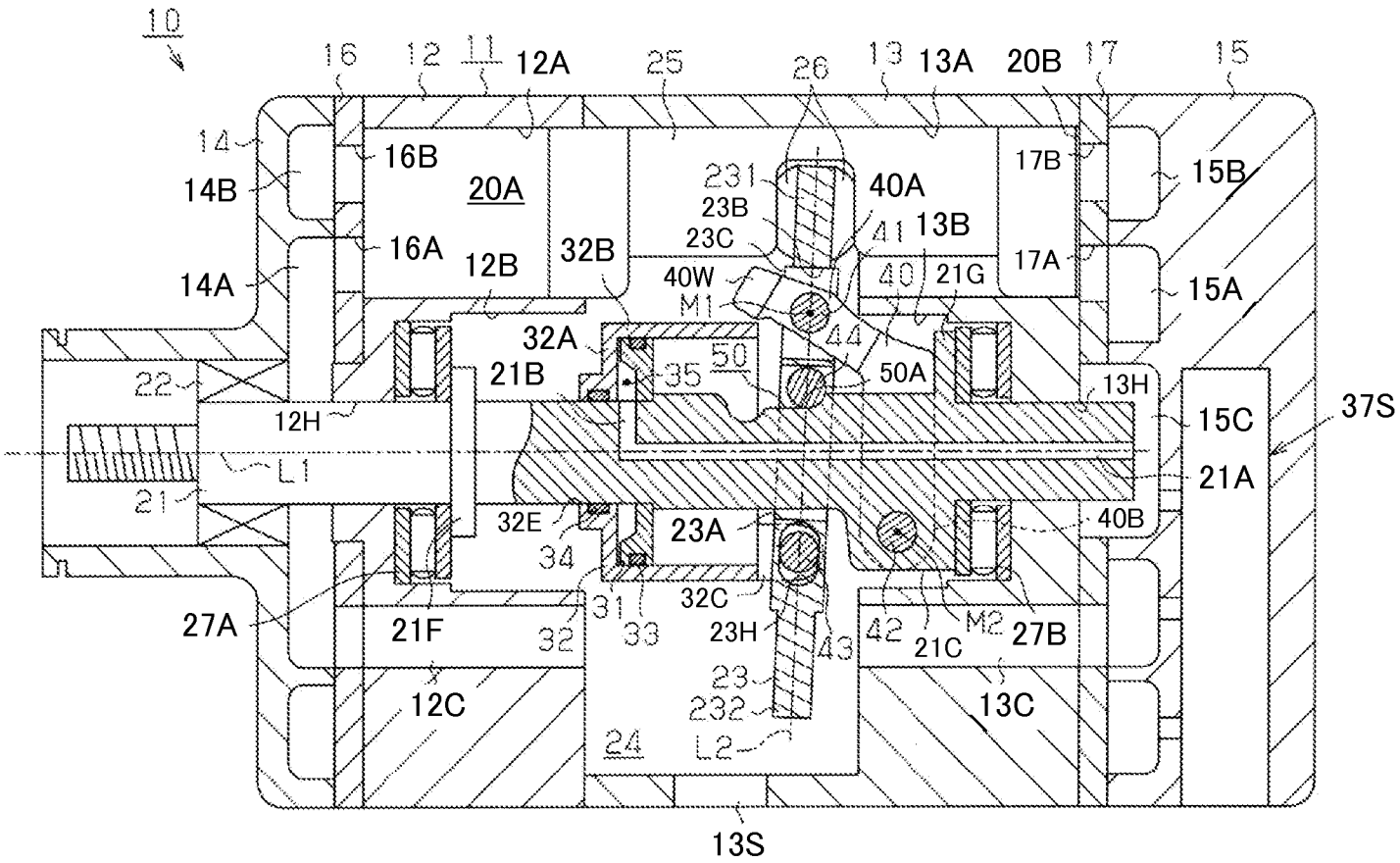
FIG. 1 is a longitudinal sectional view of a swash plate type variable displacement compressor according to an embodiment of the present invention.

The following will describe a swash plate type variable displacement compressor according to the embodiment of the present invention with reference to FIGS. 1 through 10. The swash plate type variable displacement compressor (hereinafter referred to merely as "compressor") is mounted on a vehicle and forms a part of cooling circuit for an air conditioner. Referring to FIG. 1, the compressor designated by reference numeral 10 has a housing 11 including a first cylinder block 12 and a second cylinder block 13 that are connected with each other, a front housing 14 connected to the front end of the first or front cylinder block 12, and a rear housing 15 connected to the rear end of the second or rear cylinder block 13.

The front housing 14 and the first cylinder block 12 have therebetween a first valve port forming part 16. The rear housing 15 and the second cylinder block 13 have therebetween a second valve port forming part 17.

The front housing 14 and the first valve port forming part 16 cooperate to form therebetween a suction chamber 14A and a discharge chamber 14B. The discharge chamber 14B is formed radially outward of the suction chamber 14A. The rear housing 15 and the second valve port forming part 17 cooperate to form therebetween a suction chamber 15A and a discharge chamber 15B. The rear housing 15 has therein a pressure adjust chamber 15C. The pressure adjust chamber 15C is located in the center of the rear housing 15. The suction chamber 15A is disposed radially outward of the pressure adjust chamber 15C. The discharge chamber 15B is disposed radially outward of the suction chamber 15A. The discharge chamber 14B is in communication with the discharge chamber 15B through a discharge passage not shown in the drawing. The discharge passage is in communication with an external refrigerant circuit not shown in the drawing. The discharge chambers 14B and 15B are in the discharge pressure area of the compressor 10.

The first valve port forming part 16 has therein a suction port 16A that is in communication with the suction chamber 14A and a discharge port 16B that is communication with the discharge chamber 14B. The second valve port forming part 17 has therein a suction port 17A that is in communication with the suction chamber 15A and a discharge port 17B that is in communication with the discharge chamber 15B. The suction ports 16A and 17A have a suction valve mechanism not shown in the drawing, respectively. The discharge ports 16B and 17B have a discharge valve mechanism not shown in the drawing, respectively.

A rotary shaft 21 is rotatably supported in the housing 11. The rotary shaft 21 is inserted at a part thereof adjacent to the front end thereof through a hole 12H formed through the first cylinder block 12. The front end of the rotary shaft 21 is located in the front housing 14. The rotary shaft 21 is inserted at a part thereof adjacent to the rear end thereof through a hole 13H formed therethrough in the second cylinder block 13. The rear end of the rotary shaft 21 is located in the pressure adjust chamber 15C. L1 in FIG. 1 designates a rotary shaft axis or the axis of rotation of the rotary shaft 21.

The rotary shaft 21 is rotatably supported by the first cylinder block 12 at the hole 12H thereof and also by the second cylinder block 13 at the hole 13H thereof. The front housing 14 and the rotary shaft 21 have therebetween a lip type seal device 22. The front end of the rotary shaft 21 is operatively connected through a power transmission mechanism not shown in the drawing to an engine for a vehicle as an external drive power. In the present embodiment, the power transmission mechanism is of a clutchless type (for example, a combination of a belt and a pulley) that continuously transmits power.

The housing 11 has therein a crank chamber 24 defined by the first cylinder block 12 and the second cylinder block 13. A swash plate 23 is mounted on the rotary shaft 21 for rotation therewith in the crank chamber 24. The swash plate 23 is movable in the axial direction of the rotary shaft 21 and inclinable relative to the rotary shaft 21 while being rotated about the rotary shaft axis L1. The swash plate 23 has therein a insertion hole 23A through which the rotary shaft 21 is inserted.

A plurality of first cylinder bores 12A is formed through the first cylinder block 12 in the axial direction and disposed at an equiangular distance around the rotary shaft 21 (only one first cylinder bore 12A being shown in FIG. 1). Each first cylinder bore 12A is communicable through the suction port 16A with the suction chamber 14A and through the discharge port 16B with the discharge chamber 14B, respectively. A plurality of second cylinder bores 13A is formed through the second cylinder block 13 in the axial direction and disposed at an equiangular distance around the rotary shaft 21 (only one second cylinder bore 13A being shown in FIG. 1). Each second cylinder bore 13A is communicable through the suction port 17A with the suction chamber 15A and through the discharge port 17B with the discharge chamber 15B, respectively. The first cylinder bore 12A and the second cylinder bore 13A are disposed in alignment with each other in the axial direction to form a pair of cylinder bores. A double-headed piston 25 is reciprocally slidably received in each pair of the first and second cylinder bores 12A, 13A. Thus, the swash plate type variable displacement compressor 10 according to the present embodiment is a double-headed type variable displacement compressor.

Each double-headed piston 25 is engaged with the swash plate 23 at the outer periphery thereof through a pair of shoes 26. The rotational movement of the swash plate 23 by the rotation of the rotary shaft 21 is converted into the reciprocating movement of the double-headed piston 25 in the paired cylinder bores 12A, 13A through the shoes 26. A first compression chamber 20A is defined by the double-headed piston 25 and the first valve port forming part 16 in the first cylinder bore 12A. A second compression chamber 20B is defined by the double-headed piston 25 and the second valve port forming part 17 in the second cylinder bore 13A.

The first cylinder block 12 has therein a first large hole 12B that is formed continuously with the hole 12H and larger than the hole 12H in diameter. The first large hole 12B is in communication with the crank chamber 24. The crank chamber 24 is in communication with the suction chamber 14A through a suction passage 12C which extends through the first cylinder block 12 and the first valve port forming part 16.

The second cylinder block 13 has therein a second large hole 13B that is formed continuously with the hole 13H and larger than the hole 13H in diameter. The second large hole 13B is in communication with the crank chamber 24. The crank chamber 24 is in communication with the suction chamber 15A through a suction passage 13C which extends through the second cylinder block 13 and the second valve port forming part 17.

The second cylinder block 13 has an inlet port 13S formed through the peripheral wall thereof and connected to an external refrigerant circuit. Refrigerant gas drawn from the external circuit through the inlet port 13S into the crank chamber 24 is flowed through the suction passages 12C and 13C into the suction chambers 14A and 15A. The suction chambers 14A, 15A and the crank chamber 24 are in the suction pressure area of the compressor 10 and have substantially the same pressure.

A circular flange 21F is formed extending radially from the rotary shaft 21 in the first large hole 12B. A first thrust bearing 27A is interposed between the flange 21F and the first cylinder block 12 in the axis direction of the rotary shaft 21. A circular flange 21G is formed extending radially from the rotary shaft 21 in the second large hole 13B. A second thrust bearing 27B is interposed between the flange 21G and the second cylinder block 13 in the axis direction of the rotary shaft 21.

A circular fixed member 31 is fixed on the rotary shaft 21 for rotation therewith at a position rearward of the flange 21F and forward of the swash plate 23. A movable member 32 having a bottomed cylindrical shape is movably mounted on the rotary shaft 21 at a position between the flange 21F and the fixed member 31. The movable member 32 is movable relative to the fixed member 31 in the axial direction of the rotary shaft 21.

The movable member 32 includes a circular bottom part 32A having a insertion hole 32E through which the rotary shaft 21 extends and a cylindrical part 32B formed extending rearward from the outer peripheral edge of the bottom part 32A in the axis of the rotary shaft 21. The inner peripheral surface of the cylindrical part 32B is in slide contact with the outer peripheral surface of the fixed member 31. Thus, the movable member 32 is rotatable with the rotary shaft 21 through the fixed member 31. The inner peripheral surface of the cylindrical part 32B and the outer peripheral edge of the fixed member 31 are sealed from each other by the seal device 33. The insertion hole 32E and the rotary shaft 21 are sealed from each other by the seal device 34. A pressure control chamber 35 is defined formed by the fixed member 31, the movable member 32, and the rotary shaft 21.

The rotary shaft 21 has therein a first axial passage 21A extending in the axial direction of the rotary shaft 21. The rear end of the first axial passage 21A is opened to the pressure adjust chamber 15C. Furthermore, the rotary shaft 21 has therein a second radial passage 21B extending in a radial direction of the rotary shaft 21. The second radial passage 21B is in communication at one end thereof with the front end of the first axial passage 21A and is in communication at the other end thereof with the pressure control chamber 35. Accordingly, the pressure control chamber 35 is in communication with the pressure adjust chamber 15C through the first axial passage 21A and the second radial passage 21B.

Figure 2:
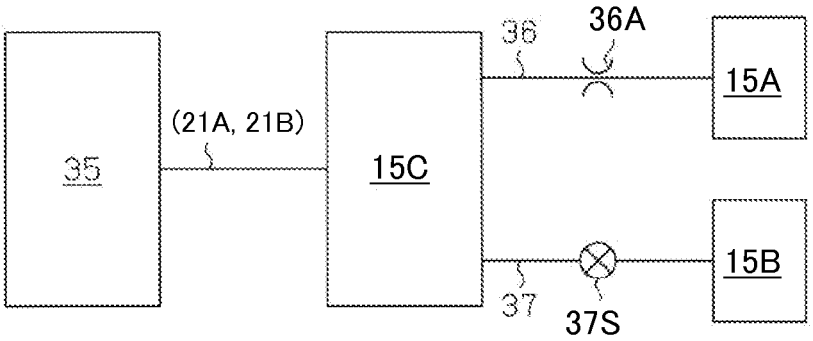
FIG. 2 is a schematic diagram showing the relation among a pressure control chamber, a pressure adjust chamber, a suction chamber, and a discharge chamber of the compressor of FIG. 1.

As shown in FIG. 2, the pressure adjust chamber 15C is in communication with the suction chamber 15A through a bleed passage 36. An orifice 36A is provided in the bleed passage 36 for controlling the flow rate of refrigerant gas flowing in the bleed passage 36. The pressure adjust chamber 15C is communicable with the discharge chamber 15B through a supply passage 37. The supply passage has therein an electro-magnetic control valve 37S that controls the flow rate of refrigerant gas flowing in the supply passage 37 according to the pressure of the suction chamber 15A. Thus, the flow rate of refrigerant gas flowing in the supply passage 37 is controlled by the control valve 37S.

Refrigerant gas is flowed from the discharge chamber 15B through the supply passage 37, the pressure adjust chamber 15C, the first axial passage 21A, and the second radial passage 21B into the pressure control chamber 35. The refrigerant gas is flowed out from the pressure control chamber 35 through the second radial passage 21B, the first axial passage 21A, the pressure adjust chamber 15C, and the bleed passage 36 into the suction chamber 15A. As a result, the pressure in the pressure control chamber 35 is changed.

The movable member 32 is moved in the axial direction of the rotary shaft 21 relative to the fixed member 31 in response to the pressure difference between the pressure control chamber 35 and the crank chamber 24. That is, the pressure of the refrigerant gas in the pressure control chamber 35 is used for controlling the movement of the movable member 32.

As shown in FIG. 1, a lug arm 40 is provided between the swash plate 23 and the flange 21G in the crank chamber 24. The lug arm 40 has a substantially L shape as shown in FIG. 1. The lug arm 40 has at one end thereof a weight 40W that is located on the front face side of the swash plate 23 extending through a hole 23B of the swash plate 23.

The lug arm 40 has at a position adjacent to one end thereof a plate-like first connecting portion 40A. The first connecting portion 40A is connected to a pair of swash plate side connecting parts 23C that are provided in the upper part (upper side of the drawing) of the swash plate 23 through a first pin 41 provided in the hole 23B. The first pin 41 serves as the first connecting member of the present invention.

Figure 3:
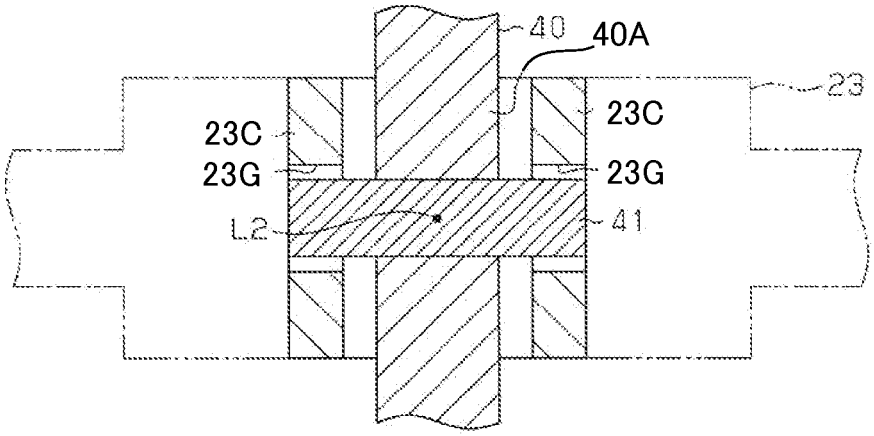
FIG. 3 is a sectional plan view showing a first pin and its surroundings in the compressor of FIG. 1.

As shown in FIG. 3, the first pin 41 is fixed in the first connecting portion 40A of the lug arm 40 by press-fitting. The opposite ends of the first pin 41 are inserted in swash plate side insertion holes 23G formed in the swash plate side connecting part 23C. The swash plate side connecting part 23C is pivotally supported on the first pin 41 so as to be rotatable relative to the first connecting portion 40A of the lug arm 40 about a first pivot M1 that is the axial center of the first pin 41.

As shown in FIG. 1, the lug arm 40 further has at the other end thereof a pair of second connecting portions 40B. The paired second connecting portions 40B are connected through a second pin 42 to a rotary shaft side connecting portion 21C that is formed extending from the outer peripheral surface of the rotary shaft 21. The second pin 42 serves as the second connecting part of the present invention. The rotary shaft side connecting portion 21C is formed integrally with the flange 21G.

Figure 4:
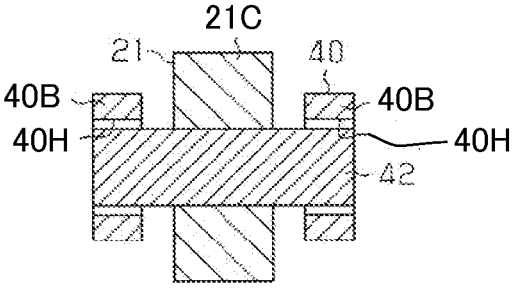
FIG. 4 is a sectional plan view showing a second pin of the compressor of FIG. 1 and its surroundings.

As shown in FIG. 4, the second pin 42 is press-fitted in the rotary shaft side connecting portion 21C. The opposite ends of the second pin 42 are inserted in lug arm side insertion holes 40H formed in the second connecting portions 40B of the lug arm 40, respectively. The second connecting portions 40B of the lug arm 40 are swingably supported on the second pin 42 so as to be rotatable relative to the rotary shaft side connecting portion 21C about a second pivot M2 that is the axial center of the second pin 42.

As shown in FIG. 1, the movable member 32 has at the rear end of the cylindrical part 32B thereof a connecting part 32C extending toward the swash plate 23. A third pin 43 is press-fitted in the connecting part 32C. An elongated hole 23H is formed in the swash plate 23 at a position adjacent to the low end (lower side in FIG. 1) thereof, through which the third pin 43 is inserted. The swash plate 23 is connected at a position adjacent to the low end thereof to the connecting part 32C through the third pin 43. The third pin 43 is slidably supported by the hole 23H.

The swash plate 23 has a point at which the double-headed piston 25 is positioned at its top dead center, which point will be hereinafter referred to as the top dead center point 231 of the swash plate 23 for the double-headed piston 25 and a point at which the double-headed piston 25 is positioned at its bottom dead center, which point will be hereinafter referred to the bottom dead center point 232 of the swash plate 23. The top dead center point 231 and the bottom dead center point 232 of the swash plate 23 for the double-headed piston 25 are located on the opposite sides of the rotary shaft 21.

A fourth pin 44, which serves as the slide part of the present invention, is provided through the insertion hole 23A in the swash plate 23. The fourth pin 44 is disposed between the top dead center point 231 of the swash plate 23 for the double-headed piston 25 and the rotary shaft 21. The swash plate 23 is rotatably supported by the fourth pin 44. The rotary shaft 21 has in a part of the outer peripheral surface thereof that faces the fourth pin 44 a guide surface 50 along which the fourth pin 44 is slidably guided according to the change of the inclination angle of the swash plate 23. The guide surface 50 is formed by a groove that is recessed in the rotary shaft 21.

Figure 5:
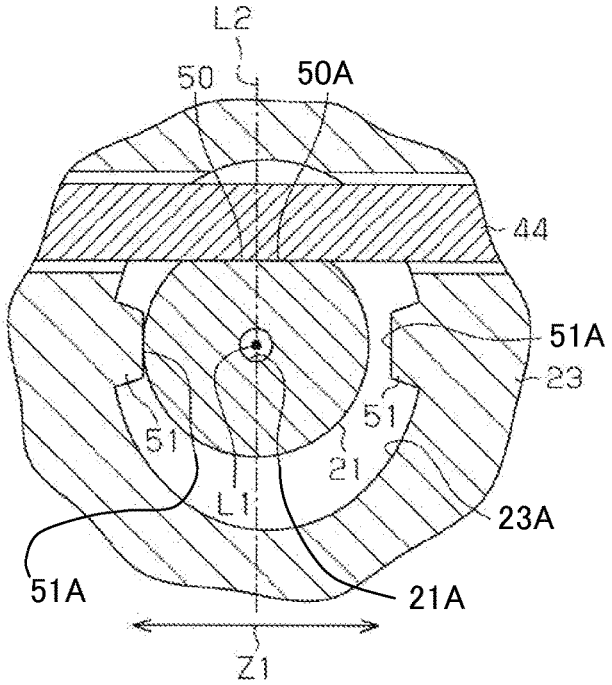
FIG. 5 is a transverse sectional view showing a swash plate and a drive shaft inserted in an insertion hole of the swash plate in the compressor of FIG. 1.

As shown in FIG. 5, the guide surface 50 has a parallel portion 50A extending parallel to a line (or the arrow direction Z1 shown in FIG. 5) that is perpendicular to the axis L1 of rotation of the rotary shaft 21 and also to the line L2 connecting the top dead center point 231 and the bottom dead center point 232 of the swash plate 23.

A pair of projections 51 are formed extending toward each other or toward the rotary shaft 21 from opposite positions on the inner peripheral surface of the insertion hole 23A that are on a line that is perpendicular to the axis L1 of rotation of the rotary shaft 21 and the line L2 connecting the top dead center point 231 and the bottom dead center point 232 of the swash plate 23. The paired projections 51 restricts the movement of the rotary shaft 21 relative to the swash plate 23 in the direction that is perpendicular to the axis L1 of rotation of the rotary shaft 21 and the line L2 connecting the top dead center point 231 and the bottom dead center point 232 of the swash plate 23. The paired projections 51 are spaced away from each other such that no simultaneous contact occurs between the paired projections 51 and the rotary shaft 21. The paired projections 51 are formed integrally with the swash plate 23 and extend along the line L2 connecting the top dead center point 231 and the bottom dead center point 232 of the swash plate 23.

Figure 6:
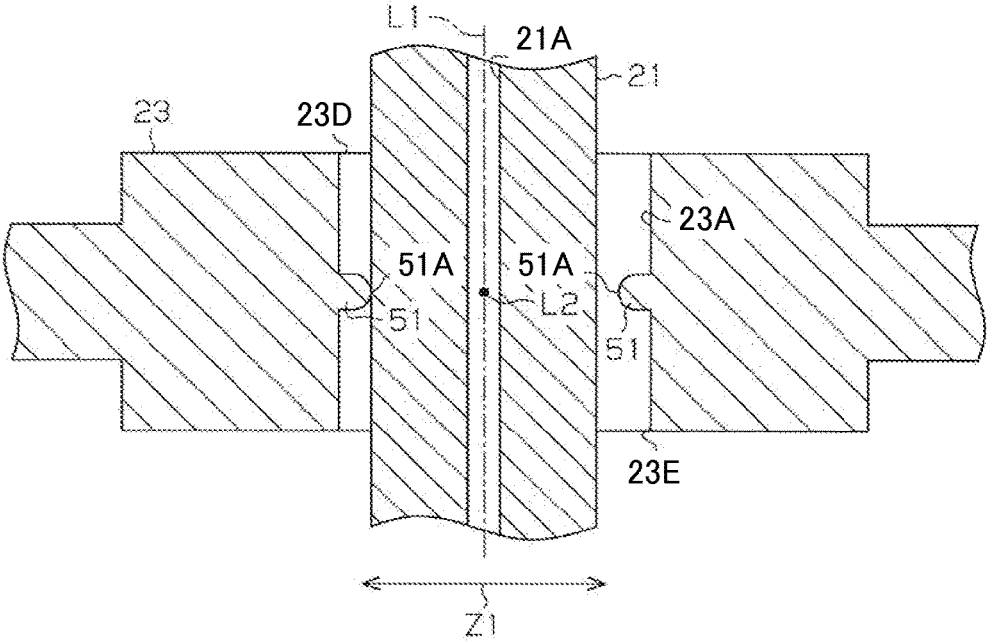
FIG. 6 is a sectional plan view showing the swash plate and the drive shaft of FIG. 5.

As shown in FIG. 6, the paired projections 51 are formed at the center as viewed in the thickness direction of the swash plate 23 and disposed opposite to each other on opposite sides of a line that is perpendicular to the axis L1 of rotation of the rotary shaft 21 and the line L2 connecting the top dead center point 231 and the bottom dead center point 232 of the swash plate 23. Each projection 51 has at the end thereof a contact surface 51A that is curved outward toward the rotary shaft 21 in an arcuate shape in section and contactable with the peripheral surface of the rotary shaft 21.

In the above-described swash plate type variable displacement compressor 10, when the valve opening of the control valve 37S is decreased, the flow rate of refrigerant gas flowing from the discharge chamber 15B through the supply passage 37, the pressure adjust chamber 15C, the first axial passage 21A, and the second radial passage 21B into the pressure control chamber 35 is reduced. Then, refrigerant gas is flowed out from the pressure control chamber 35 through the second radial passage 21B, the first axial passage 21A, the pressure adjust chamber 15C, and the bleed passage 36 into the suction chamber 15A. As a result, the pressure of the pressure control chamber 35 becomes substantially the same as that of suction chamber 15A. Therefore, the reduction of the pressure difference between the pressure control chamber 35 and the crank chamber 24 causes the movable member 32 to move in such direction that causes the bottom part 32A of the movable member 32 to move toward the fixed member 31.

When the movable member 32 is moved so that the bottom part 32A of the movable member 32 approaches the fixed member 31, the third pin 43 is moved in the hole 23H and the swash plate side connecting part 23C is swung about the first pivot M1, as shown in FIG. 1. According to such swinging of the swash plate side connecting part 23C about the first pivot M1, the second connecting portions 40B of the lug arm 40 are swung about the second pivot M2 and the lug arm 40 approaches the flange 21G. Therefore, the inclination angle of the swash plate 23 is deceased and the stroke length of the double-headed piston 25 is reduced, accordingly, so that the displacement of the compressor 10 is decreased.

When the valve opening of the control valve 37S is increased, the flow rate of refrigerant gas flowing from the discharge chamber 15B through the supply passage 37, the pressure adjust chamber 15C, the first axial passage 21A, and the second radial passage 21B into the pressure control chamber 35 is increased, so that the pressure of the pressure control chamber 35 becomes substantially the same as that of discharge chamber 15B. Then, the pressure difference between the pressure control chamber 35 and the crank chamber 24 is increased, with the result that the movable member 32 is moved so that the bottom part 32A of the movable member 32 is moved away from the fixed member 31.

Figure 7:
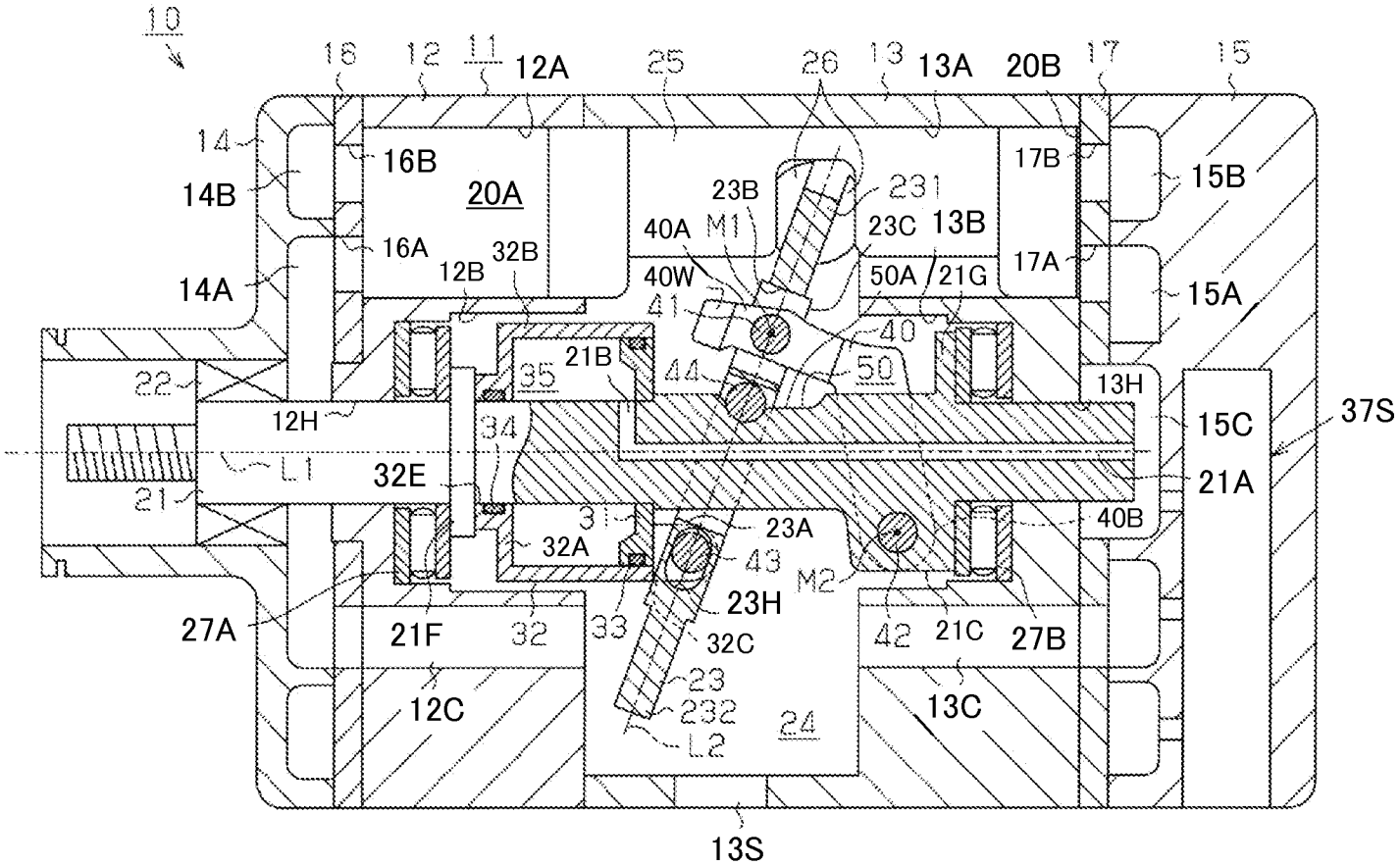
FIG. 7 is a longitudinal sectional view of the compressor of FIG. 1 with the swash plate positioned in the maximum inclination angle.

As shown in FIG. 7, when the movable member 32 is moved so that the bottom part 32A of the movable member 32 is moved away from the fixed member 31, the third pin 43 is moved in the hole 23H and the swash plate side connecting part 23C is swung about the first pivot M1 in the direction opposite to the direction that causes the inclination angle of the swash plate 23 to decrease. According to such swinging of the swash plate 23 about the first pivot M1, the second connecting portions 40B of the lug arm 40 are swung about the second pivot M2 in the direction different from the swinging direction that causes the inclination angle of the swash plate 23 to decrease and the lug arm 40 to move away from the flange 21G. Thus, the inclination angle of the swash plate 23 is increased and the stroke length of the double-headed piston 25 becomes large, accordingly, so that the displacement of the compressor 10 is increased.

In the present embodiment, the compressor has a link mechanism that is configured of the lug arm 40, the first pin 41, and the second pin 42 to change the inclination angle of the swash plate 23 according to the movement of the movable member 32. The link mechanism has a plurality of connecting members to connect the rotary shaft 21 and the swash plate 23, such as the first pin 41 and the second pin 42. The swash plate 23 is supported on the rotary shaft 21 through the link mechanism, the movable member 32, and the fourth pin 44 so that the inclination angle of the swash plate 23 relative to the rotary shaft 21 is controlled.

Figure 8:
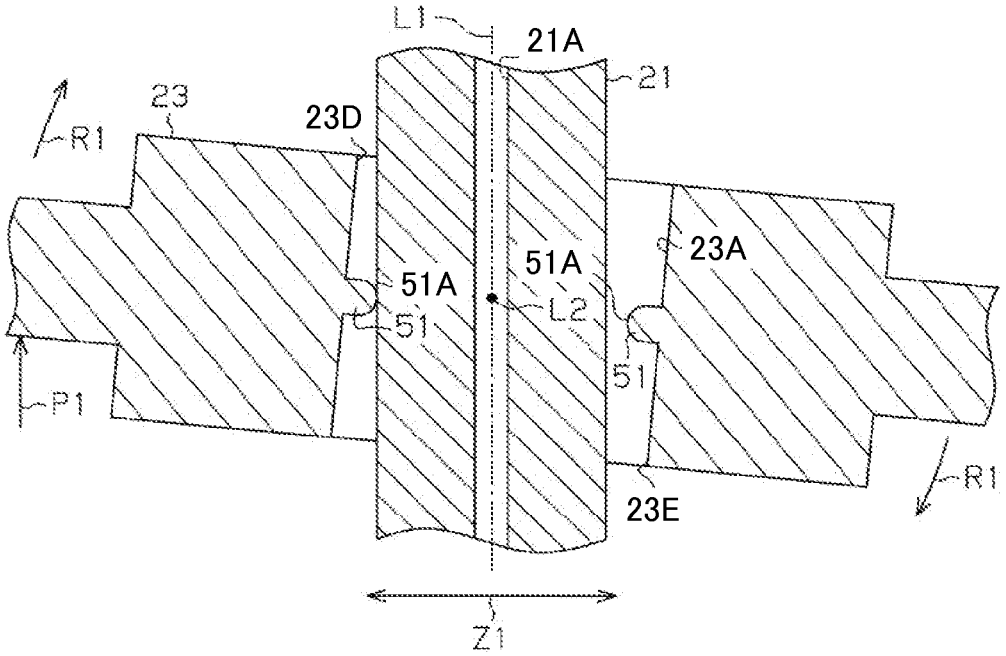
FIG. 8 is a sectional plan view of the swash plate and the drive shaft in the compressor of FIG. 1, showing a state in which the swash plate is inclined in a direction that is different from the direction in which the swash plate is inclined.

The following will describe the operation of the compressor according to the present embodiment. Referring to FIG. 8, in the swash plate type variable displacement compressor 10, the compression reaction force P1 acts on the swash plate 23 through the double-headed pistons 25. This compression reaction force P1 causes the swash plate 23 to be inclined about the line L2 connecting the top dead center point 231 and the bottom dead center point 232 of the swash plate 23 in the arrow direction R1 (FIG. 8) that is different from the direction in which the swash plate 23 is inclined in accordance with the displacement control of the compressor 10.

Figure 9:
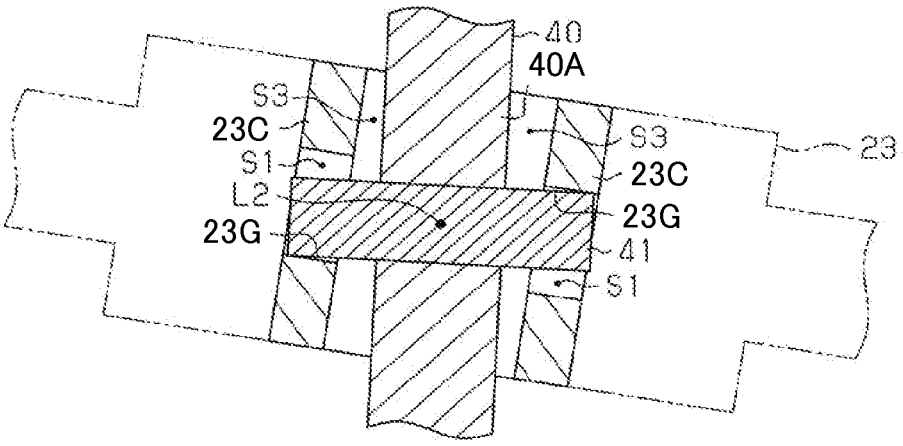
FIG. 9 is a sectional plan view of the swash plate and a lug arm in the compressor of FIG. 1, showing a state in which the swash plate is inclined and the lug arm is rotated in the direction that is different from the direction in which the swash plate is inclined and the lug arm is rotated (swung) in accordance with the displacement control of the compressor.

As shown in FIG. 9, when the swash plate 23 is inclined in such different direction, the inner peripheral surface of the swash plate side insertion hole 23G is brought into contact with the first pin 41. Due to such contact between the inner peripheral surface of the swash plate side insertion hole 23G and the first pin 41, the lug arm 40 receives a force that tends to rotate (swing) the lug arm 40 through the first pin 41 in a direction that is different from the direction in which the lug arm 40 is rotated (swung) in accordance with the displacement control of the compressor 10. Thus, the lug arm 40 is rotated (swung) in such different direction.

Figure 10:
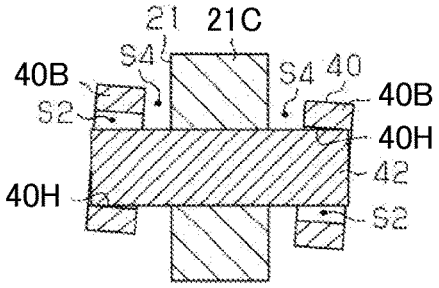
FIG. 10 is a sectional plan view of the swash plate, the lug arm, and a second pin in the compressor of FIG. 1, showing a state in which the lug arm is rotated in the direction that is different from the direction in which the lug arm is rotated (swung) in accordance with the displacement control of the compressor and the second pin is brought into contact with the inner peripheral surface of a lug arm side insertion hole.
Figure 11:
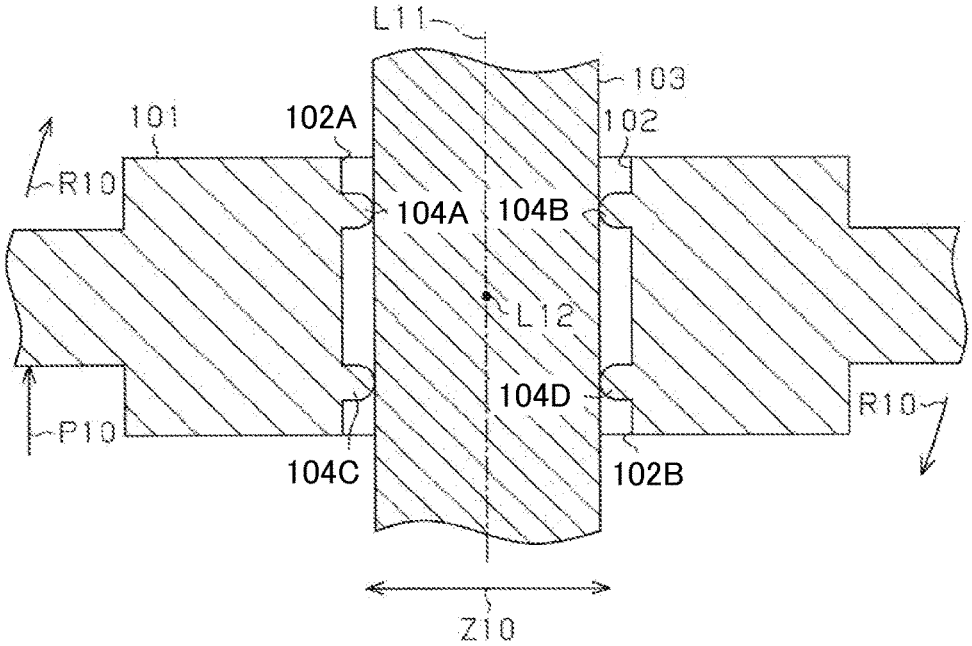
FIG. 11(background art)
FIG. 11 is a sectional plan view showing a swash plate and a rotary shaft of a swash plate type variable displacement compressor according to a background art.

When the lug arm 40 is rotated in the different direction, the inner peripheral surface of each lug arm side insertion hole 40H is brought into contact with the second pin 42, as shown in FIG. 10, so that a force tending to cause the lug arm 40 to rotate in the direction that is different from the direction in which the lug arm 40 is rotated (swung) in accordance with the displacement control of the compressor 10 acts on the rotary shaft side connecting portion 21C through the second pin 42. Thus, the rotation of the lug arm 40 in the different direction is prevented. Furthermore, the inclination of the swash plate 23 in the direction that is different from the direction in which the swash plate 23 is inclined in accordance with the displacement control of the compressor 10 is prevented.

In the present embodiment, a gap S1 between the swash plate side insertion hole 23G and the first pin 41 (FIG. 9) and a gap S2 between the lug arm side insertion hole 40H and the second pin 42 (FIG. 10) are set to such an extent that the inclination of the swash plate 23 about the line L2 connecting the top dead center point 231 and the bottom dead center point 232 of the swash plate 23 is prevented by the contact between the inner peripheral surface of the swash plate side insertion hole 23G and the first pin 41 and the contact between the inner peripheral surface of the lug arm side insertion hole 40H and the second pin 42.

In this case, the rotary shaft 21 is in contact with one of the paired projections 51, as shown in FIG. 8, so that the swash plate 23 is prevented from moving relative to the rotary shaft 21 in the direction that is perpendicular to the axis L1 of rotation of the rotary shaft 21 and also to the line L2 connecting the top dead center point 231 and the bottom dead center point 232 of the swash plate 23. Furthermore, in the inner peripheral surface of the insertion hole 23A of the swash plate 23, the edges 23D and 23E that are located in perpendicular relation to the axis L1 of rotation of the rotary shaft 21 and also to the line L2 connecting the top dead center point 231 and the bottom dead center point 232 of the swash plate 23 is prevented from being brought into contact with the rotary shaft 21. The spaced distance between the paired projections 51 is set such that the paired projections 51 are not in contact with the rotary shaft 21 simultaneously. Therefore, the moment load that is generated from the compression reaction force P1 about the line L2 connecting the top dead center point 231 and the bottom dead center point 232 of the swash plate 23 and acts on the projections 51 is restricted, and the projections 51 have no friction with the rotary shaft 21 simultaneously. As a result, the positioning of the swash plate 23 can be accomplished accurately and the change of the inclination angle of the swash plate 23 is performed smoothly.

The contact between the inner peripheral surface of the swash plate side insertion hole 23G and the first pin 41 and the contact between the inner peripheral surface of the lug arm side insertion hole 40H and the second pin 42 restrict the inclination of the swash plate 23 about the line L2 connecting the top dead center point 231 and the bottom dead center point 232 of the swash plate 23. Therefore, the contact between the inner peripheral surface of the insertion hole 23A of the swash plate 23 and the rotary shaft 21 is prevented successively and the rotary shaft 21 is brought into contact with either one of the projections 51 and the change of the inclination angle of the swash plate 23 is easily performed.

The fourth pin 44 of the swash plate 23 is guided by the guide surface 50 having the parallel portion 50A extending parallel to a line that is perpendicular to the axis L1 of rotation of the rotary shaft 21 and the line L2 connecting the top dead center point 231 and the bottom dead center point 232 of the swash plate 23, so that the inclination angle of the swash plate 23 is changed. The force that causes the swash plate 23 to be inclined in a direction that is perpendicular to the axis L1 of rotation of the rotary shaft 21 and the line L2 connecting the top dead center point 231 and the bottom dead center point 232 of the swash plate 23 is suppressed. As a result, the swash plate 23 is restricted from being inclined to the perpendicular direction of to the axis L1 of rotation of the rotary shaft 21 and the line L2 connecting the top dead center point 231 and the bottom dead center point 232 of the swash plate 23, so that the friction resistance between the rotary shaft 21 and one of the paired projections 51 is prevented from increasing.

When the rotary shaft 21 is in contact with one of the paired projections 51, a gap S3 remains between each swash plate side connecting part 23C and the first connecting portion 40A of the lug arm 40 and also a gap S4 between the second connecting portion 40B of the lug arm 40 and the rotary shaft side connecting portion 21C, as shown in FIGS. 9 and 10. That is, the spaced distance between each swash plate side connecting part 23C and the first connecting portion 40A of the lug arm 40 is set to such a extent that each swash plate side connecting part 23C is not in contact with the first connecting portion 40A of the lug arm 40 before the rotary shaft 21 is in contact with one of the paired projections 51. Similarly, the spaced distance between the second connecting portion 40B of the lug arm 40 and the rotary shaft side connecting portion 21C is set to such an extent that the second connecting portion 40B of the lug arm 40 is not in contact with the rotary shaft side connecting portion 21C before the rotary shaft 21 is in contact with one of the paired projections 51.

According to the configuration described above, in changing the inclination angle of the swash plate 23, no contact between each swash plate side connecting part 23C and the first connecting portion 40A of the lug arm 40 and no contact between the second connecting portion 40B of the lug arm 40 and the rotary shaft side connecting portion 21C occur. Because of the contact between the rotary shaft 21 and one of the paired projections 51, the inclination angle of the swash plate 23 is changed in a state in which the swash plate 23 is positioned in a perpendicular relation to the axis L1 of rotation of the rotary shaft 21 and the line L2 connecting the top dead center point 231 and the bottom dead center point 232 of the swash plate 23.

The present embodiment has the following advantageous effects. (1) The paired projections 51 are formed extending toward the rotary shaft 21 from opposite positions on the insertion hole 23A and restricts the movement of the rotary shaft 21 in the direction that is perpendicular to the line L2 connecting the top dead center point 231 and the bottom dead center point 232 of the swash plate 23. The paired projections 51 are spaced away from each other such that no simultaneous contact occurs between the paired projections 51 and the rotary shaft 21. Because of the contact between the rotary shaft 21 and only one projection 51 at one time, the swash plate 23 is restricted from moving relative to the rotary shaft 21 in a direction perpendicular to the axis L1 of rotation of the rotary shaft 21 and the line L2 connecting the top dead center point 231 and the bottom dead center point 232 of the swash plate 23. Furthermore, even if the swash plate 23 is inclined about the line L2 connecting the top dead center point 231 and the bottom dead center point 232 of the swash plate 23, due to the compression reaction force P acting from the double-headed piston 25 on the swash plate 23, in the direction that is different from the direction in which the swash plate 23 is inclined in accordance with the displacement control of the compressor, the rotary shaft 21 is brought into contact with one of the paired projections 51. Therefore, the edges 23D and 23E of the inner peripheral surface of the swash plate 23 are prevented from being brought into contact with the rotary shaft 21, as compared to a case that no paired projections are provided in the insertion hole 23A. The paired projections 51 are spaced away from each other such that the paired projections 51 are not in contact with the rotary shaft 21 simultaneously. Therefore, in changing the inclination angle of the swash plate 23, the moment load that is generated from the compression reaction force P1 about the line L2 connecting the top dead center point 231 and the bottom dead center point 232 of the swash plate 23 is restricted from acting on the projections 51, unlike the case that both projections 51 are in contact with the rotary shaft 21. Accordingly, friction between only one of the projections 51 and the rotary shaft 21 occurs. As a result, the positioning of the swash plate 23 can be accomplished accurately and the change of the inclination angle of the swash plate 23 is performed smoothly.

(2) The rotary shaft 21 has therein the guide surface 50 for guiding the fourth pin 44. The guide surface 50 has the parallel portion 50A extending parallel to a line that is perpendicular to the axis L1 of rotation of the rotary shaft 21 and the line L2 connecting the top dead center point 231 and the bottom dead center point 232 of the swash plate 23. According to the configuration described above, the inclination angle of the swash plate 23 is changed with the fourth pin 44 being guided by the guide surface 50 having the parallel portion 50A. Thus, in changing the inclination angle of the swash plate 23, force acting on the swash plate 23 in the direction perpendicular to the axis L1 of rotation of the rotary shaft 21 and the line L2 connecting the top dead center point 231 and the bottom dead center point 232 of the swash plate 23 is restricted. As a result, increase of the friction resistance between the rotary shaft 21 and one of the paired projections 51 due to the inclination of the swash plate 23 in the direction perpendicular to the axis L1 of rotation of the rotary shaft 21 and the line L2 connecting the top dead center point 231 and the bottom dead center point 232 of the swash plate 23 is restricted. Therefore, the inclination angle of the swash plate 23 is changed more smoothly.

(3) The contact between the inner peripheral surface of the swash plate side insertion hole 23G and the first pin 41 and the contact between the inner peripheral surface of the lug arm side insertion hole 40H and the second pin 42 restrict the inclination of the swash plate 23 about the line L2 connecting the top dead center point 231 and the bottom dead center point 232 of the swash plate 23. According to the configuration described above, even if the swash plate 23 tends to be inclined in the direction against the displacement control of the compressor about the line L2 connecting the top dead center point 231 and the bottom dead center point 232 of the swash plate 23, the inner peripheral surface of the insertion hole 23A of the swash plate 23 is prevented from being brought into contact with the rotary shaft 21. The rotary shaft 21 is in contact with only one of the paired projections 51, so that the inclination angle of the swash plate 23 can be changed more smoothly.

(4) The contact surface 51A of the projection 51 for contact with the rotary shaft 21 is curved outward in an arcuate shape in section. This shape enables smooth contact between the projection 51 and the rotary shaft 21. Therefore, the friction between the projection 51 and the rotary shaft 21 is reduced, so that the inclination angle of the swash plate 23 can be changed more smoothly.

(5) Unlike a swash plate type variable displacement compressor having a single-headed piston, the crank chamber of a double-headed type variable displacement compressor cannot serve as a pressure control chamber to control the inclination angle of the swash plate 23. In the present embodiment, the inclination angle of the swash plate 23 is controlled by changing the pressure of the pressure control chamber 35 that is defined by the movable member 32, the fixed member 31, and the rotary shaft 21. The pressure control chamber 35 is smaller than the crank chamber 24. Accordingly, refrigerant gas flowed into the pressure control chamber 35 may be small, so that changing of the inclination angle of the swash plate 23 is preformed with good responsiveness. In the present embodiment, the inclination angle of the swash plate 23 can be changed smoothly, so that the volume of refrigerant gas to be used in the pressure control chamber 35 may be small.

(6) The spaced distance between each swash plate side connecting part 23C and the first connecting portion 40A of the lug arm 40 is set to such a extent that each swash plate side connecting part 23C is not in contact with the first connecting portion 40A of the lug arm 40 before the rotary shaft 21 is in contact with one of the paired projections 51. Similarly, the spaced distance between the second connecting portion 40B of the lug arm 40 and the rotary shaft side connecting portion 21C is set to such an extent that the second connecting portion 40B of the lug arm 40 is not in contact with the rotary shaft side connecting portion 21C before the rotary shaft 21 is in contact with one of the paired projections 51. According to the above described configuration, in changing the inclination angle of the swash plate 23, no contact between each swash plate side connecting part 23C and the first connecting portion 40A of the lug arm 40 and no contact between the second connecting portion 40B of the lug arm 40 and the rotary shaft side connecting portion 21C occur. Because of the contact between the rotary shaft 21 and one of the paired projections 51, the inclination angle of the swash plate 23 is changed in a state in which the swash plate 23 is positioned in a perpendicular relation to the axis L1 of rotation of the rotary shaft 21 and the line L2 connecting the top dead center point 231 and the bottom dead center point 232 of the swash plate 23.

(7) Let us suppose that the paired projections 51 are formed at a position adjacent to either one side of the swash plate 23 as viewed in the thickness direction of the swash plate 23. In this case, when the swash plate 23 is inclined in a direction against the displacement control of the compressor, the edges 23D and 23E of the insertion hole 23A of the swash plate 23 may be brought into contact with the rotary shaft 21. In order to prevent such contact, a recess needs to be formed at the edges 23D and 23E of the insertion hole 23A of the swash plate 23. In the present embodiment, the paired projections 51 are formed at the center in the thickness direction of the swash plate 23 and opposite to each other on opposite sides of a line that is perpendicular to the axis L1 of rotation of the rotary shaft 21 and the line L2 connecting the top dead center point 231 and the bottom dead center point 232 of the swash plate 23. According to the configuration described above, no recess needs to be formed at the edges 23D and 23E of the insertion hole 23A of the swash plate 23 to prevent the edges 23D and 23E from being brought into contact with the rotary shaft 21. Therefore, the swash plate 23 is made with good rotational balance in the thickness direction of the swash plate 23.

The above embodiment may be modified as follows. The paired projections 51 may not be disposed in opposite relation to each other on opposite sides of a line that is perpendicular to the axis L1 of rotation of the rotary shaft 21 and the line L2 connecting the top dead center point 231 and the bottom dead center point 232 of the swash plate 23. For example, one of the paired projections 51 may be disposed at a position adjacent to either one end of the swash plate 23 in the thickness direction of the swash plate 23 and the other of the paired projections 51 at a position adjacent to the other end of the swash plate 23. It is noted that in such a case the projections 51 need to be disposed so that the moment load that is generated from the compression reaction force P1 about the line L2 connecting the top dead center point 231 and the bottom dead center point 232 of the swash plate 23 is prevented.

The paired projections 51 may be disposed at a position adjacent to either one end of the swash plate 23 in the thickness direction of the swash plate 23. In the embodiment of the FIG. 1, the paired projection 51 may be of a square column shape, a triangular column shape, or a triangular pyramid shaped. That is, the contact surface 51A of the paired projection 51 that is formed at the end thereof to be brought into contact with the rotary shaft 21 may not be curved in arcuate shape.

The paired projections 51 may be made as a separate part and joined to the inner peripheral surface of the insertion hole 23A of the swash plate 23. The guide surface 50 may not have the parallel portion 50A. The fourth pin 44 and the guide surface 50 may be dispensed with.

The fourth pin 44 may be replaced by a slide part that is formed integrally with the swash plate 23 for slide contact with the rotary shaft 21. The fourth pin 44 may not be rotatable relative to the swash plate 23. That is, the fourth pin 44 may be non-rotatable.

The connecting part 32C of the movable member 32 may have therein an elongated hole and a pin such as 43 may be fixed to the swash plate 23 at a position adjacent to the low end of the swash plate 23 and inserted through the elongated hole. An orifice such as 36A may be provided in the supply passage 37 through which the pressure adjust chamber 15C is in communication with the discharge chamber 15B in the supply passage 37 that provides fluid communication between the pressure adjust chamber 15C and the discharge chamber 15B and an electro magnetic control valve such as 37S may be provided in the bleed passage 36 through which the pressure adjust chamber 15C is communicable with the suction chamber 15A.

Though the swash plate type variable displacement compressor 10 has been described as a double-headed piston type variable displacement compressor having double-headed pistons, the present invention is applicable to a single-headed piston type variable displacement compressor having single-headed piston. In this case, changing of the inclination angle of the swash plate 23 may be controlled by the movable member 32. Alternatively, it may be so configured that the movable member 32 is dispensed with and the changing of the inclination angle of the swash plate 23 is controlled by introducing refrigerant gas into the crank chamber 24 having a function as a pressure control chamber.

The compressor may be driven through a clutch from an external drive source.

What is claimed is:

1. A swash plate type variable displacement compressor comprising:

a housing;

a swash plate disposed in the housing and having therethrough an insertion hole;

a rotary shaft inserted through the insertion hole of the swash plate;

a plurality of pistons engaged with the swash plate; and a connecting member disposed between the rotary shaft and the swash plate and connecting the rotary shaft and the swash plate so as to change an inclination angle of the swash plate relative to the rotary shaft, wherein the swash plate has a first point at which one of the pistons is positioned at a top dead center and a second point at which one of the pistons is positioned at a bottom dead center, wherein the swash plate is movable relative to the rotary shaft in a lateral direction that is perpendicular to both an axis of rotation of the rotary shaft and a line connecting the first point and the second point of the swash plate, wherein when the inclination angle of the swash plate is changed relative to the rotary shaft, stroke lengths of the pistons are changed to vary displacement of the compressor, wherein a pair of projections are provided in the insertion hole so as to extend toward the rotary shaft in the lateral direction and restrict movement of the swash plate relative to the rotary shaft in the lateral direction, and the pair of projections are spaced away from each other so as not to be in contact with the rotary shaft simultaneously, wherein the swash plate has a slide part that is in slide contact with the rotary shaft and the rotary shaft has a guide surface guiding the slide part, and wherein the guide surface is a recessed portion of the rotary shaft.

2. The swash plate type variable displacement compressor according to claim 1, a link mechanism fixed on the rotary shaft and rotated integrally with the rotary shaft; a fixed member fixed on the rotary shaft; a movable member connected to the swash plate and movable in an axial direction of the rotary shaft relative to the fixed member so as to change the inclination angle of the swash plate; and a control chamber defined by the movable member, the fixed member, and the rotary shaft, wherein the swash plate is rotatably supported by the rotary shaft through the link mechanism, the movable member, and the slide part so as to restrict the inclination angle of the swash plate relative to the rotary shaft.

3. The swash plate type variable displacement compressor according to claim 1, wherein each projection has a contact surface that is contactable with the rotary shaft and curved in an arcuate shape.

4. The swash plate type variable displacement compressor according to claim 1, wherein the piston is a double-headed piston.

5. The swash plate type variable displacement compressor according to claim 1, further comprising: a link mechanism fixed on the rotary shaft and rotated integrally with the rotary shaft; a fixed member fixed on the rotary shaft; a movable member connected to the swash plate and movable in an axial direction of the rotary shaft relative to the fixed member so as to change the inclination angle of the swash plate; and a control chamber defined by the movable member, the fixed member, and the rotary shaft, wherein the rotary shaft comprises an axial passage in fluid communication with the control chamber.

6. The swash plate type variable displacement compressor according to claim 1, wherein the slide part comprises a first pin extending through a portion of the swash plate, and the swash plate further comprises a second pin extending through another portion of the swash plate.

7. The swash plate type variable displacement compressor according to claim 1, wherein the slide part comprises a first pin extending through a portion of the swash plate.

8. A swash plate type variable displacement compressor comprising:

a housing; a swash plate disposed in the housing and having therethrough an insertion hole; a rotary shaft inserted through the insertion hole of the swash plate; a plurality of pistons engaged with the swash plate; and a connecting member disposed between the rotary shaft and the swash plate and connecting the rotary shaft and the swash plate so as to change an inclination angle of the swash plate relative to the rotary shaft, wherein the swash plate has a first point at which one of the pistons is positioned at a top dead center and a second point at which one of the pistons is positioned at a bottom dead center, wherein the swash plate is movable relative to the rotary shaft in a lateral direction that is perpendicular to both an axis of rotation of the rotary shaft and a line connecting the first point and the second point of the swash plate, wherein when the inclination angle of the swash plate is changed relative to the rotary shaft, stroke lengths of the pistons are changed to vary displacement of the compressor, wherein a pair of projections are provided in the insertion hole so as to extend toward the rotary shaft and restrict lateral movement of the swash plate relative to the rotary shaft, and the pair of projections are spaced away from each other so as not to be in contact with the rotary shaft simultaneously; wherein the housing includes: a link mechanism fixed on the rotary shaft and rotated integrally with the rotary shaft; a fixed member fixed on the rotary shaft; a movable member connected to the swash plate and movable in an axial direction of the rotary shaft relative to the fixed member so as to change the inclination angle of the swash plate; and a control chamber defined by the movable member, the fixed member, and the rotary shaft, wherein the swash plate has a slide part that is in slide contact with the rotary shaft and the rotary shaft has a guide surface guiding the slide part, wherein the swash plate is rotatably supported by the rotary shaft through the link mechanism, the movable member, and the slide part so as to restrict the inclination angle of the swash plate relative to the rotary shaft, wherein the guide surface comprises a recessed portion of the rotary shaft; wherein the link mechanism includes: a plurality of the connecting members including a first connecting member and a second connecting member; and a lug arm rotated integrally with the rotary shaft connected to the swash plate through the first connecting member and connected to the rotary shaft through the second connecting member for rotation with the rotary shaft, wherein the lug arm includes: a first connecting portion connected to a swash plate side connecting part of the swash plate; and a second connecting portion connected to a rotary shaft side connecting portion of the rotary shaft, wherein the swash plate side connecting part has therein a swash plate side insertion hole through which the first connecting member is inserted, wherein the second connecting portion has therein a lug arm side insertion hole through which the second connecting member is inserted, wherein the swash plate side connecting part is supported by the first connecting member so as to be swingable relative to the first connecting portion, wherein the second connecting portion is supported by the second connecting member so as to be swingable relative to the rotary shaft side connecting portion, wherein a contact between an inner peripheral surface of the swash plate side insertion hole and the first connecting member and a contact between an inner surface of the lug arm side insertion hole and the second connecting member cooperate to restrict the swing of the swash plate about the line connecting the first point and the second point of the swash plate.

* * * * *